US006408498B1

(12) United States Patent
Fields et al.

(10) Patent No.: US 6,408,498 B1
(45) Date of Patent: Jun. 25, 2002

(54) CAN END HAVING A STRENGTHENED SIDE WALL AND APPARATUS AND METHOD OF MAKING SAME

(75) Inventors: Brian Fields, Hinsdale; Lloyd Wilson, Aurora, both of IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/625,772

(22) Filed: Jul. 26, 2000

Related U.S. Application Data

(62) Division of application No. 09/140,722, filed on Aug. 26, 1998, now Pat. No. 6,102,243.

(51) Int. Cl.[7] ..... B23P 11/00
(52) U.S. Cl. ..... 29/243.5
(58) Field of Search ..... 413/5, 6; 29/505, 29/506, 509, 510, 511, 281.4, 243.5, 243.52

(56) References Cited

U.S. PATENT DOCUMENTS

| | | | | |
|---|---|---|---|---|
| 2,321,408 | A | | 6/1943 | Mills et al. |
| 2,346,165 | A | | 4/1944 | Hothersall |
| 2,700,355 | A | | 1/1955 | Erb |
| 3,023,927 | A | | 3/1962 | Ehman |
| 3,409,168 | A | | 11/1968 | Chmielowiec |
| 3,417,898 | A | | 12/1968 | Bozek et al. |
| 3,537,291 | A | | 11/1970 | Hawkins |
| 3,650,387 | A | | 3/1972 | Hornsby et al. |
| 3,672,318 | A | * | 6/1972 | Nicholson ..... 29/509 |

(List continued on next page.)

FOREIGN PATENT DOCUMENTS

| | | | |
|---|---|---|---|
| AU | 1444470 | | 7/1976 |
| DE | 92 11 788.0 | | 2/1993 |
| EP | 0 139 282 | A2 | 5/1985 |
| EP | 0153115 | A3 | 8/1985 |
| EP | 0 177 426 1 | | 4/1986 |
| EP | 0340955 | A1 | 11/1989 |
| GB | 2 067 159 | A | 7/1981 |
| GB | 2143202 | A | 2/1985 |
| GB | 2196891 | A | 5/1988 |
| GB | 2218024 | A | 11/1989 |
| GB | 2 288 759 | B | 11/1995 |
| JP | 57-117323 | | 7/1982 |
| JP | 2-192837 | | 7/1990 |
| WO | WO93/17864 | | 9/1993 |
| WO | WO96/37414 | | 11/1996 |

OTHER PUBLICATIONS

Society of Soft Drink Technologists, "Beverage, Can, End & Double Seam Dimensional Specifications", Revised Aug. 1993.

US Brewers Association, Inc., "Brewing Industry Recommended Can Specifications Manual", Revised 1983.

Moran, P., "Double Seam Formation", *Beverage Can 'Mini Seams' Double Seam Manual,* published at least as early as Apr. 1, 1995, pp. 7–8.

*Primary Examiner*—Robert C. Watson
(74) *Attorney, Agent, or Firm*—Woodcock Washburn LLP

(57) ABSTRACT

A method and apparatus for seaming a can end to a can body and a can made thereby. The can end has a side wall forming an angle in the range of about 12° to 15°. A seaming chuck is inserted into the can end adjacent its side wall. The seaming chuck has upper and lower walls. The upper wall is essentially cylindrical or slightly negatively tapered. The lower wall is disposed at an angle very close to that of the can end side wall so that the upper and lower chuck side walls form an obtuse angle in the range of about 162° to 168°. A can seamed using such a chuck will have a segmented, kinked side wall comprising upper and lower substantially straight sections intersecting at a circumferentially extending crease and forming an obtuse angle.

5 Claims, 3 Drawing Sheets

U.S. PATENT DOCUMENTS 3,843,014 A 10/1974 Cospen et al.
3,957,005 A 5/1976 Heffner
3,967,752 A 7/1976 Cudzik
4,015,744 A 4/1977 Brown
4,024,981 A 5/1977 Brown
4,031,837 A 6/1977 Jordan
4,093,102 A 6/1978 Kraska
4,102,467 A 7/1978 Woodley
4,109,599 A 8/1978 Schultz
4,148,410 A 4/1979 Brown
4,150,765 A 4/1979 Mazurek
4,210,257 A 7/1980 Radtke
4,217,843 A 8/1980 Kraska
4,276,993 A 7/1981 Hasegawa
4,308,970 A 1/1982 Von Holdt
4,365,724 A 12/1982 Walden
4,402,421 A 9/1983 Ruemer, Jr.
4,434,641 A 3/1984 Nguyen
4,448,322 A 5/1984 Kraska
4,516,420 A 5/1985 Bulso, Jr. et al.
D279,265 S 6/1985 Turner et al.
4,524,879 A 6/1985 Fundom et al.
4,538,758 A 9/1985 Griffith
4,549,424 A 10/1985 Bulso, Jr. et al.
4,559,801 A 12/1985 Smith et al.
4,567,746 A 2/1986 Bachmann et al.
4,571,978 A 2/1986 Taube et al.
4,574,608 A 3/1986 Bulso, Jr. et al.
4,577,774 A 3/1986 Nguyen
4,578,007 A 3/1986 Diekhoff
4,587,825 A 5/1986 Buslo, Jr. et al.
4,587,826 A 5/1986 Bulso, Jr. et al.
4,606,472 A 8/1986 Taube et al.
D285,661 S 9/1986 Brownbill
4,626,158 A 12/1986 Le Bret
4,641,761 A 2/1987 Smith et al.
4,667,384 A * 5/1987 Miller ..... 29/509
4,674,649 A 6/1987 Pavely
4,681,238 A 7/1987 Sanchez
4,685,582 A 8/1987 Pulciani et al.
4,697,972 A 10/1987 Le Bret et al.
4,713,958 A 12/1987 Bulso, Jr. et al.
4,715,208 A 12/1987 Bulso, Jr. et al.
4,716,755 A 1/1988 Bulso, Jr. et al.
4,722,215 A 2/1988 Taube et al.
4,735,863 A 4/1988 Bachmann et al.
4,784,282 A 11/1988 Le Bret et al.
4,808,052 A 2/1989 Bulso, Jr.et al.
4,809,861 A 3/1989 Wilkinson et al.
D300,608 S 4/1989 Taylor et al.
4,823,973 A 4/1989 Jewitt et al.
4,865,506 A 9/1989 Kaminski
D304,302 S 10/1989 Dalli et al.
4,893,725 A 1/1990 Ball et al.
4,903,521 A 2/1990 Bulso, Jr. et al.
4,930,658 A 6/1990 McEldowney
4,932,554 A 6/1990 Smith et al.
4,934,168 A 6/1990 Osmanski et al.
4,955,223 A 9/1990 Stodd et al.
4,977,772 A 12/1990 Bulso, Jr. et al.
4,991,735 A 2/1991 Biondich
5,016,785 A 5/1991 Greenebaum, II
5,046,637 A 9/1991 Kysh
5,064,087 A 11/1991 Koch
5,069,356 A 12/1991 Zysset
5,071,302 A 12/1991 Wahler
5,115,938 A 5/1992 Thompson
5,129,541 A 7/1992 Voigt et al.
5,143,504 A 9/1992 Braakman
5,149,238 A 9/1992 McEldowney et al.
5,221,183 A 6/1993 Hoeffken
D337,521 S 7/1993 McNulty
5,346,087 A 9/1994 Klein
5,356,256 A 10/1994 Turner et al.
D352,898 S 11/1994 Vacher
5,460,286 A 10/1995 Rush et al.
5,494,184 A 2/1996 Noguchi et al.
5,582,319 A 12/1996 Heyes et al.
5,595,322 A 1/1997 Kramer
5,636,761 A 6/1997 Diamond et al.
5,685,189 A 11/1997 Nguyen et al.
D406,236 S 3/1999 Brifcani et al.
5,971,259 A 10/1999 Bacon

* cited by examiner

CAN END HAVING A STRENGTHENED SIDE WALL AND APPARATUS AND METHOD OF MAKING SAME

This is divisional of Ser. No. 09/140,722 filed Aug. 26, 1998, now U.S. Pat. No. 6,102,243.

FIELD OF THE INVENTION

The current invention is directed to a can, such as a metal can used to package carbonated beverages. More specifically, the current invention is directed to a can having an end with improved strength, and to an apparatus and method for making such a can.

BACKGROUND OF THE INVENTION

Beverages, such as carbonated beverages, are typically packaged in cans made of metal, such as aluminum. Two piece cans are typically formed by seaming a can end to a can body. Traditionally, seaming is accomplished by forming a can end 10, shown in FIG. 1, in a die press. The can end 10 typically has a circular countersink bead 16, a substantially flat center panel 18, a seaming panel 13 that terminates in a peripheral curl 12, and a frustoconical side wall portion 14 that extends between the bead and the seaming panel. Traditionally, the side wall 14 is disposed at an angle A of about 14° with respect to a line parallel to the centerline 7 of the can body 20. (Unless otherwise indicated, the numerical value of all angles referred to herein should be understood to be positive, meaning that the angle tapers away from the centerline of the can body as it extends upward in the direction from the bottom of the can body toward the can end. A negative angle is an angle that extends toward the centerline as it extends upward in the direction from the bottom of the can body toward the can end.)

Seaming is performed by disposing a flange 11 of the can body 20 under the seaming panel 13 on the can end 10. A seaming chuck 2 is then inserted into the can end 10, as shown in FIG. 1. Traditionally, seaming chucks 2 have frustoconical upper and lower wall portions 4 and 6, respectively. The lower wall portion 6 is typically disposed at an angle B that is a few degrees less than the angle A of the can end side wall 14 so that if the angle A of the can end side wall were about 14°, the angle B of the chuck lower wall would be about 11°. The upper wall portion 4, which typically has a length L of about 0.130 inch, is typically disposed at an angle C that is about 4°. Thus, the upper and lower wall portions 4 and 6 intersect at an edge 5 so as to form an obtuse angle of about 173° (i.e., 180°+4°−11°). Typically, the edge 5 has a radius of curvature of about 0.005 inch. Since the angle B of the lower wall 6 of the chuck 2 is less than the angle A of the can end lower wall 14, a relatively large gap, which may be as much as 0.010 inch, is formed between the chuck side wall and the can end side wall in the vicinity of the chuck wall edge 5, as shown in FIG. 1.

Seaming is completed by sequentially applying first and second seaming rolls against the curl 12 so as to press the curl and the flange 11 against the upper chuck wall 4, thereby producing a standard double seam 22, shown in FIG. 2.

Unfortunately, although pressed against the chuck 2 during seaming, the side wall 14 of the can end tends to spring back—that is, radially outward—when the pressure of the seaming roll is relieved. Thus, despite the fact that the upper and lower walls 4 and 6 of conventional seaming chucks 2 form two straight, frustoconical sections, the resulting side wall 14' of the can end 10' after seaming is arcuate, having a relatively large radius of curvature $R_1$, as shown in FIG. 2.

The curved nature of the seamed side wall 14' weakens the strength of the seamed can end 10'.

Recently, a non-standard can end has been developed in which the side wall, after seaming, is formed by two straight sections intersecting at a circumferentially extending crease. Such a can end is shown in published PCT application WO 96/37414. This structure is achieved by initially forming the can end side wall at a large angle that is said to be preferably in the range of 40° to 45°. According to the approach described in this published PCT application, the seaming chuck has a lower wall disposed at a similarly large angle and an upper wall disposed at an angle in the range of +4° to 4°. While this approach results in a strengthened can end, unfortunately, the large can end side wall angle required in this approach precludes its application to standard can ends, in which the side wall angle is only about 14°, as previously discussed.

Consequently, it would be desirable to provide a method and apparatus for seaming a conventional end to a can such that the resulting seamed can end had a side wall of improved strength.

SUMMARY OF THE INVENTION

It is an object of the current invention to provide a method and apparatus for seaming a conventional end to a can such that the resulting seamed can end had a side wall of improved strength. This and other objects is accomplished in a method of seaming a can end to a can body comprising the steps of (i) forming a can end having a side wall and a seaming panel, the side wall formed by a single substantially straight section disposed at an angle with respect to the central axis that is within the range of about 12° to 15°, (ii) inserting a chuck into the can end adjacent the side wall, the chuck having upper and lower portions forming upper and lower chuck walls, the lower chuck wall being substantially frustoconical and disposed at an angle with respect to the central axis that is no less than the angle at which the substantially straight section of the can end side wall is disposed with respect to the central axis, the upper chuck wall disposed at an angle with respect to the central axis that is within the range of about 0° to −2°, and (iii) seaming the seaming panel of the can end to a can body so as to reshape the can end side wall into upper and lower substantially straight sections, the upper and lower substantially straight sections intersecting at an obtuse angle.

The current invention also encompasses a chuck for use in seaming a can end to a can body, comprising (i) an upper portion forming an upper wall, the upper wall being disposed at an angle with respect to the central axis that is within the range of about 0° to −2°, and (ii) a lower portion forming a lower wall, the lower wall being substantially frustoconical and disposed at an angle with respect to the upper wall that is within the range of about 162° to 168°.

The current invention also encompasses a seamed can comprising (i) a can body defining a central axis thereof, and (ii) a can end seamed to the can body, the can end having a side wall formed by upper and lower substantially straight sections, the lower substantially straight section disposed at an angle with respect to the central axis that is in the range of about 12° to 15°, the upper and lower substantially straight sections intersecting at an obtuse angle so as to form a circular crease separating the upper and lower substantially straight sections.

DESCRIPTION OF THE PREFERRED EMBODIMENT

Figure 4:
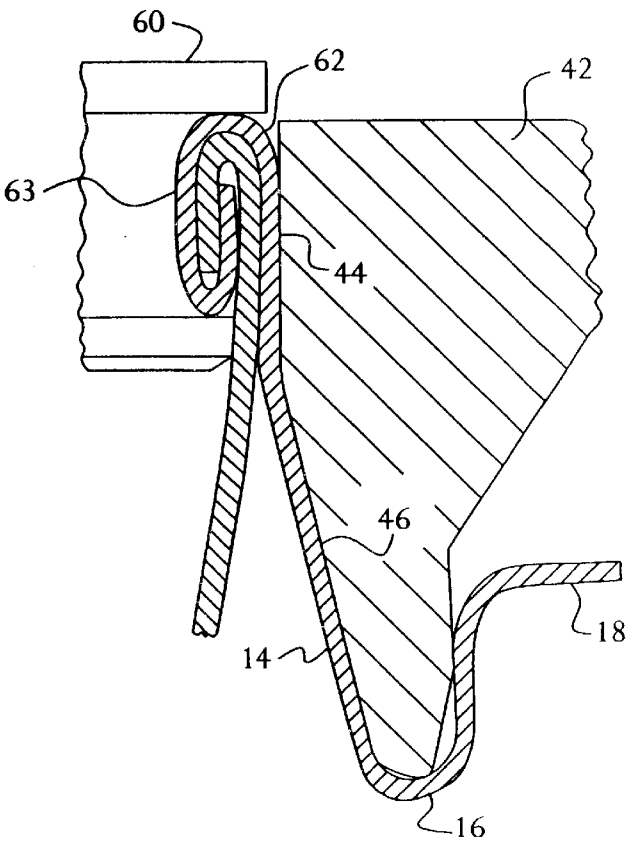
FIG. 4 is a cross-sectional view showing the can end shown in FIG. 3 being seamed according to the current invention.
Figure 3:
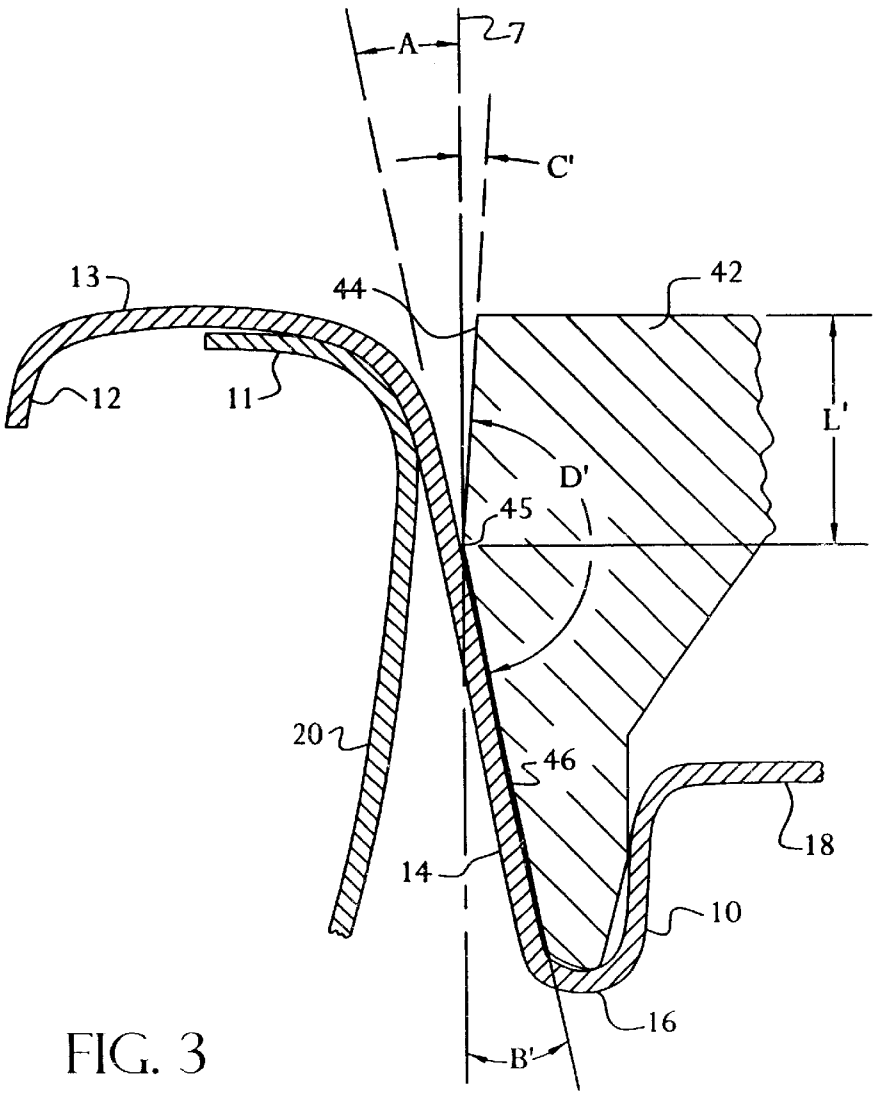
FIG. 3 is a cross-sectional view of a can end and can body prior to seaming but after the insertion of a seaming chuck into the can end, according to the current invention.

A novel method of seaming a conventional can end 10 to a conventional can body 20 according to the current invention is shown in FIGS. 3 and 4. As previously discussed, the can end 10 is typically made from metal, such as aluminum, and formed in a die press using techniques well known in the art. The can body 20 is also made from a metal, such as aluminum, and may be formed in a drawing and ironing process, again, using techniques well known in the art. As is also conventional, the frustoconical side wall 14 of the can end 10, which extends between the bead 16 and the seaming panel 13, is disposed at an angle A with respect to a line 7 parallel to the central longitudinal axis of the can body 20 that is in the range of about 12° to 15°, and preferably about 14°.

Prior to seaming, the flange 11 of the can body 20 is placed under the seaming panel 13 formed adjacent the can end side wall 14. A seaming chuck 42, constructed according to the current invention and discussed further below, is then inserted into the can end 10 adjacent the side wall 14 so that the distal end of the chuck enters the bead 16. The seaming chuck 42 has un upper wall 44 and a lower wall 46 that intersect at a circumferentially extending edge 45.

According to the current invention, the lower wall 46 of the chuck 42 is disposed at an angle B' with respect to a line 7 parallel to the central axis of the can body, which coincides with the central axis of the chuck, that is very close to the angle A of the can end side wall 14. Specifically, the angle B' should be no less than, and most preferably slightly greater than, the angle A. Thus, when the angle A of the can end side wall 14 is disposed at the preferred angle of about 14°, the angle B' of the chuck lower wall 46 should be within the range of about 14° to 15°. In general, the angle B' of the lower chuck wall 14 according to the invention should be in the range of about A to A +1° (since standard can ends have side wall angles in about the 12° to 15° range, as previously discussed, chucks 42 according to the current invention will have lower wall angles in about the 12° to 16° range). As a result of this relationship between the can end and chuck wall angles according to the current invention, there is little or no gap between the edge 45 of the chuck side wall and the can end side wall 14, as shown in FIG. 3, when the chuck 42 is inserted into the can end 10. In fact, preferably, there is a slight interference between the edge 45 of the chuck wall and the side wall 14 of the can end when the chuck 42 is fully inserted into the bead 16.

Figure 6:
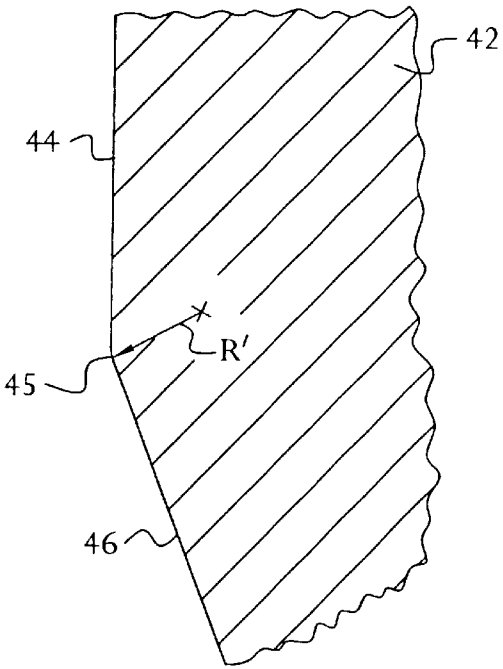
FIG. 6 is a cross-sectional detailed view of a portion of the chuck shown in FIGS. 3 and 4, according to the current invention.

According to the current invention, the upper wall 44 of the chuck 42 is cylindrical or slightly negatively tapered, being disposed at an angle C' with respect to a line 7 parallel to the central axis that is within the range of about 0° to −2°, and is preferably about −1°. Thus, chucks 42 made in accordance with the current invention will have upper and lower walls 44 and 46 that intersect at an obtuse angle D' in the range of about 162° (i.e., 180°−2°−16°) to 168° (i.e., 180°−0°−12°) depending on the angle A of the can end side wall 14 to be seamed. Preferably the upper and lower walls 44 and 46 intersect at an obtuse angle of about 165° (i.e., 180°−1°−14°) if the can end side wall 14 is formed at the preferred angle of about 14°. Significantly, this angle D' is less than the approximately 173° angle D traditionally associated with seaming chucks 2 for conventional can ends 10, discussed above. As shown in FIG. 6, preferably, a radius R' in the range of about 0.001 to 0.020 inch, and preferably about 0.010 inch, is formed on the edge 45. Moreover, the upper wall 44 of the chuck 42 has a length L', indicated in FIG. 3, of approximately 0.1 inch.

As is conventional, seaming is accomplished by sequentially applying a series of rotating seaming rolls 60, one of which is shown in FIG. 4, to the curl 12 so that the forming surface 63 of the roll 60 presses the curl and flange 11 against the upper wall 44 of the chuck 42, thereby forming a double seam 62.

Figure 5:
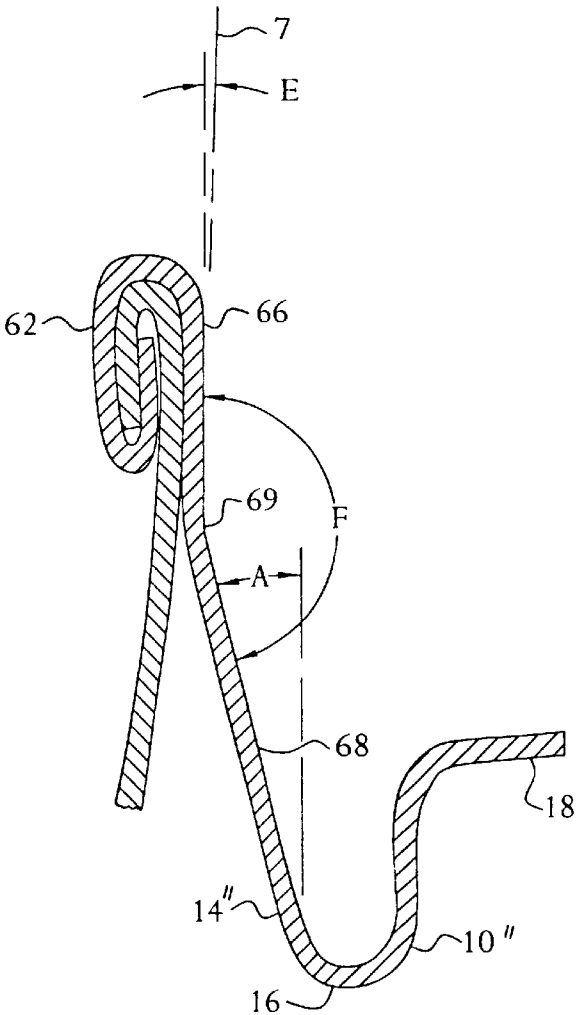
FIG. 5 is a cross-sectional view of the can end of the current invention after seaming.

Employing the seaming chuck 42 of the current invention results in a seamed can end 10" such as that shown in FIG. 5. In contrast to arcuate side wall 14' of a conventionally seamed can end 10, such as that shown in FIG. 2, the side wall 14" of the can end 10" seamed according to the current invention is segmented. As shown in FIG. 5, the can end side wall is comprised of a substantially straight upper segment 66 and a substantially straight, frustoconical lower segment 68. The upper and lower segments 66 and 68 intersect at a circumferentially extending crease or kink 69. The substantially straight upper segment 66 extends from the seam 62 to the crease 69, and the substantially straight, frustoconical lower segment 68 extends from the crease to the bead 16.

The angle A of the can end lower wall 68 with respect to a line 7 parallel to the central axis will generally remain essentially unchanged as a result of seaming according to the current invention, being in the range of about 12° to 15°, and preferably being about 14°, as previously discussed. Although pressed firmly against the chuck upper wall 44 during seaming, after seaming, the can end upper side wall 66 will spring back—that is, radially outward—slightly. Consequently, the angle E of the can end upper side wall 66 with respect to a line 7 parallel to the central axis will generally be in the range of about 0° to 2°. Thus, in can ends seamed according to the current invention, the obtuse angle F at which the upper and lower side walls 66 and 68 intersect will generally be in the range of about (180°−0°−A) to (180°+2°−A), or about 165° (i.e., 180°+0°−15°) to about 170° (i.e., 180°+2°−12°) if the can ends are initially formed with a side wall angle A in about the 12° to 15° range. If the can end were initially formed with a side wall angle A of about 14°, the side wall segments in the resulting seamed can end would intersect at an obtuse of about 166° (180°−0°−14°) to 168° (180°+2°−14°).

Figure 1:
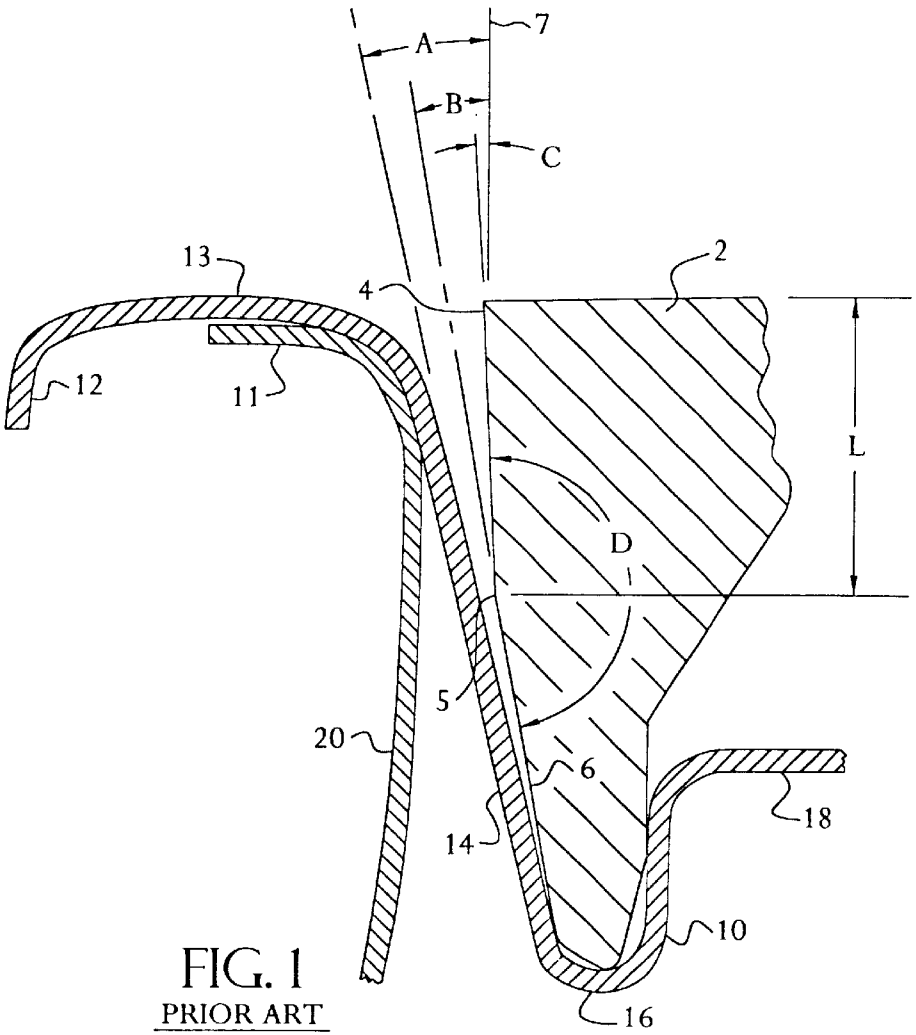
FIG. 1 PRIOR ART
FIG. 1 is a cross-sectional view of a can end and can body prior to seaming but after the insertion of a seaming chuck into the can end, according to the prior art.
Figure 2:
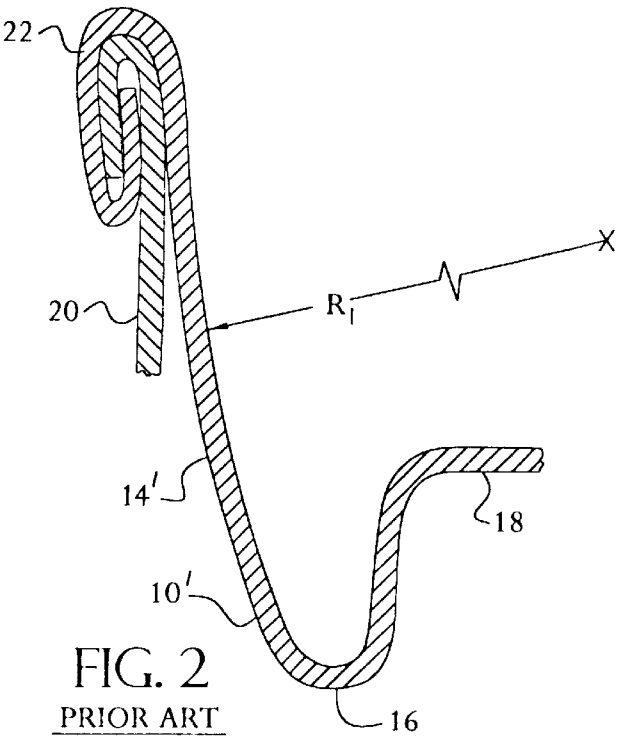
FIG. 2 PRIOR ART
FIG. 2 is a cross-sectional view of the can end shown in FIG. 1 after seaming, according to the prior art.

Significantly, seaming according to the current invention causes the can end side wall 14 to permanently kink so as to form a segmented side wall comprised of two substantially straight sections, rather than the unitary, generally arcuate side wall that resulted from conventional seaming methods, shown in FIG. 2. This segmented wall structure is created, in part, by closely matching the angles of the chuck and can end side walls so that little or no radial gap is formed between the chuck side wall edge 45 and the can end side wall 14 prior to seaming. The absence a radial gap allows the radially inward motion of the seaming roll 60 to more readily permanently deform the can end side wall.

The formation of the segmented side wall is also facilitated by the fact that the obtuse angle D' of the chuck 42 is sufficiently small to result in permanent kinking of the side wall during seaming. Surprisingly, permanent kinking is achieved without resorting to non-standard can ends having the large side wall angles, as high as 45°, thought necessary according to the prior art, as previously discussed. Rather, according to the current invention, a kink may be reliably formed during seaming of a conventional can end, having a side wall angle in the 12° to 15° range, by reducing the obtuse angle D' at which the chuck walls intersect to an angle no greater than about 168°. Such reduction in the obtuse angle D' between the chuck side walls is created by employing an angle B' in the chuck lower wall 46 that is very close to, or slightly larger than, the angle A of the can end side wall 14, as previously discussed. This is contrary to the conventional wisdom in the art, which taught that the angle of the chuck lower wall should be several degrees less than the angle of the can end side wall, as previously discussed.

The reduction in the obtuse angle D' at which the chuck walls intersect is also facilitated by forming the upper wall 44 of the chuck 42 so that, rather than being positively tapered as in conventional seaming chucks, the upper chuck wall is cylindrical or slightly negatively tapered, as previously discussed. The use of a cylindrical or negatively tapered chuck upper wall was previously thought unacceptable in the art because of the widely held assumption that such an approach would make it difficult to strip the can end from the chuck. Surprisingly, the inventors have concluded that, with the chuck 42 according to the current invention, the can end side wall 66 will spring back sufficiently far after seaming to allow the can end 10" to be easily stripped from the chuck, even when the angle of the upper chuck wall is negatively tapered as much as −2°.

A can end 10" made according to the current invention, so as to have a segmented side wall comprised of at least two substantially straight frustoconical portions 66 and 68, will have increased strength, especially increased hoop strength, when compared to the arcuate can end side walls 14' that result from conventional seaming methods, shown in FIG. 2.

The present invention may be embodied in other specific forms without departing from the spirit or essential attributes thereof and, accordingly, reference should be made to the appended claims, rather than to the foregoing specification, as indicating the scope of the invention.

What is claimed:

1. A chuck for use in seaming a can end to a can body, said chuck defining a central axis thereof, said can end having a side wall disposed at an angle A with respect to said central axis in the range of about 12° to 15°, comprising:

a) an upper portion forming an upper wall, said upper wall being disposed at an angle C with respect to said central axis that is within the range of about 0° to −2°; and b) a lower portion forming a lower wall, said lower wall being substantially frustoconical and disposed at an angle D' with respect to said upper wall that is within the range of about 162° to 168° and being disposed at an angle B' with respect to said central axis that is not greater than about 16°.

2. The chuck according to claim 1, wherein said upper and lower chuck walls intersect at an edge, said edge forming a radius in the range of about 0.001 to 0.020 inch.

3. A chuck for use in seaming a can end to a can body, said chuck defining a central axis thereof, said can end having a side wall disposed at an angle A with respect to said central axis, comprising:

a) an upper portion forming an upper wall, said upper wall being disposed at an angle C with respect to said central axis that is not a positive angle; and b) a lower portion forming a lower wall, said lower wall being substantially frustoconical and disposed at an angle B with respect to said central axis that is not less than said angle A of said can end side wall and is not greater than about 16°.

4. The chuck according to claim 3, wherein said angle C with which said upper wall is disposed is in the range of about 0° to −2°.

5. The chuck according to claim 3, wherein said upper and lower chuck walls intersect at an edge, said edge forming a radius in the range of about 0.001 to 0.020 inch.

* * * * *

UNITED STATES PATENT AND TRADEMARK OFFICE

CERTIFICATE OF CORRECTION

PATENT NO. : 6,408,498 B1 
DATED : June 25, 2002
INVENTOR(S) : Brian Fields and Lloyd Wilson It is certified that error appears in the above-identified patent and that said Letters Patent is hereby corrected as shown below:

Title page,
Item [56], FOREIGN PATENT DOCUMENTS, delete "0 177 426 1" and insert -- 0 177 426 A1 --;
U.S. PATENT DOCUMENTS, delete "4,587,825 A 5/1986 Buslo, Jr. et al." and insert -- 4,587,825 A 5/1986 Bulso, Jr. et al. --;

Column 1,
Line 5, delete "This is divisional of" and insert -- This is a divisional of U.S. Patent Application --;

Column 2,
Line 13, delete "to 4º." and insert -- to 4º. --;

Column 4,
Line 54, after "obtuse" insert -- angle --;
Line 65, after "absence" insert -- of --.

Signed and Sealed this

Seventh Day of October, 2003

JAMES E. ROGAN
*Director of the United States Patent and Trademark Office*